US007322512B2

(12) United States Patent
Higer

(10) Patent No.: US 7,322,512 B2
(45) Date of Patent: Jan. 29, 2008

(54) COIN HOLDER

(76) Inventor: Adam M. Higer, 20021 NE. 21st Ct., North Miami Beach, FL (US) 33179

( * ) Notice: Subject to any disclaimer, the term of this patent is extended or adjusted under 35 U.S.C. 154(b) by 0 days.

(21) Appl. No.: 11/423,185

(22) Filed: Jun. 9, 2006

(65) Prior Publication Data

US 2007/0023493 A1 Feb. 1, 2007

Related U.S. Application Data

(60) Provisional application No. 60/703,182, filed on Jul. 28, 2005.

(51) Int. Cl.
*A45C 1/12* (2006.01)

(52) U.S. Cl. ..... 232/1 D; 206/0.8; 206/0.82

(58) Field of Classification Search ..... 232/1 D; 206/0.8, 0.82, 0.83, 0.84; 229/92.9, 87.2; 40/323
See application file for complete search history.

(56) References Cited

U.S. PATENT DOCUMENTS 618,497 A * 1/1899 Crabb ..... 229/92.9
1,482,433 A * 2/1924 Hoffman et al. ..... 229/92.9
2,389,312 A * 11/1945 Honza ..... 206/0.82
2,449,204 A * 9/1948 Glenn ..... 206/0.83
2,459,292 A * 1/1949 Sherbondy ..... 206/0.84
2,597,227 A * 5/1952 Colliton ..... 232/5
3,075,638 A * 1/1963 Blendinger ..... 206/0.84
3,193,090 A * 7/1965 Hudgeons, Sr. et al. ... 206/0.83
3,302,773 A * 2/1967 Weir et al. ..... 206/0.83
3,405,864 A * 10/1968 Sloat ..... 229/92.9
3,474,897 A 10/1969 Rambow
3,554,625 A * 1/1971 Sly, Sr. ..... 312/234
3,595,383 A * 7/1971 Boylan ..... 206/312
3,776,643 A 12/1973 Titoff
3,837,475 A 9/1974 Bolanz
3,844,410 A 10/1974 Cook
4,043,477 A 8/1977 Deese
4,402,399 A 9/1983 Friess
4,466,534 A * 8/1984 Dunn ..... 206/777
5,590,761 A 1/1997 Owen

* cited by examiner

*Primary Examiner*—William L. Miller
(74) *Attorney, Agent, or Firm*—Robert M. Schwartz; David W. Barman

(57) ABSTRACT

The present invention is an apparatus for holding a coin, wherein the apparatus comprises a plurality of scored concentric circular regions that may be removed as needed to accommodate the diameter of different size coins.

14 Claims, 2 Drawing Sheets

COIN HOLDER

INDEX TO RELATED APPLICATIONS

This application claims the benefit of U.S. Provisional Patent Application Ser. No. 60/703,182, filed on Jul. 28, 2005.

BACKGROUND OF THE INVENTION

Coins, medals, and the like stamped from a flat piece of metal have been used in trade from the earliest times of recorded history. Generally, such coins are stamped on both sides (known as obverse and reverse sides) from relatively small discs of precious or other metal. More recently, various manufacturers have developed innumerable coins, medals, and the like to commemorate various events, associations, etc. These coins and medals are also generally stamped or minted from flat metal discs, with two opposed dies being used to form an image on both sides of the coin.

Coin collecting is a popular hobby. Significant aspects of the hobby include the safe storage and attractive display of coins within a collection. One known method for storing coins is to provide circular openings in cardboard or fiberboard sheets which are bound together by a flexible backing. The resulting "book" typically provides a date labeled opening or coin receiving depression for each year in which a particular coin was minted. This type of prior art book is suitable for its intended purpose, but room for additional innovation remains in the field of coin displays and/or storage systems.

There have been numerous inventions related to the coin collecting hobby.

U.S. Pat. No. 3,474,897 issued on Oct. 28, 1969 to Walter Rambow, titled "Display Device For Objects Such As Coins And The Like," describes a display board having a series of sockets into which a series of plugs may be removably installed. Each of the plugs holds a circular coin display holder thereon. In other embodiments, a series of ribs are placed on the board, with the ribs having shoulders for gripping the edges of the coin holders. None of the embodiments disclosed by Rambow provide for customizing the size of the coins displayed in the holders.

U.S. Pat. No. 3,776,643 issued on Dec. 4, 1973 to Victor Titoff, titled "Device For Simultaneously Displaying The Front And Rear Of Coins," describes a stand in which one or more coins are held by clips which hold their bottom edges. A mirror is provided in back of the coins, for viewing the reverse sides thereof.

U.S. Pat. No. 3,837,475 issued on Sep. 24, 1974 to Gerrit M. Bolanz, titled "Storage Device For Coins And Similar Objects," describes an adjustable rack for holding a single coin. The Bolanz device is adjustable to hold coins of different diameters, with the adjustable portion held in a sealed enclosure with transparent panels on each side thereof. While Bolanz allows for holding coins of different diameters, his holder is unduly complex, and would be cost prohibitive to be used on a wide scale by coin collectors.

U.S. Pat. No. 3,844,410 issued on Oct. 29, 1974 to Luther N. Cook, titled "Mounting Of Coins In The Faces Of Coin Albums," describes the pivotal mounting of coins in a relatively thin sheet of material, between a pair of horizontally opposed pivots.

U.S. Pat. No. 4,043,477 issued on Aug. 23, 1977 to Raymond E. Deese, titled "Coin Display," describes a series of generally rectangular, interlocking frames, each of which may hold a single coin between two transparent sheets of material. The coins are held in place by inserts which hold each coin centered within its corresponding frame.

U.S. Pat. No. 4,402,399 issued on Sep. 6, 1983 to Wolfgang Friess, titled "System For The Storage Of Coins And The Like," describes a flat plate sandwich structure for holding a series of coins therein. A central layer includes a series of passages therethrough for holding coins therein, with an unbroken clear sheet of material overlying the central sheet.

U.S. Pat. No. 5,590,761 issued on Jan. 7, 1997 to David B. Owen, titled "Coin Display Holder," describes a device having an opening with a series of three generally radially disposed flexible arms extending inwardly from the wall of the opening.

There is a need to provide a simple inexpensive coin holder that can be quickly adapted to hold coins of various diameters.

The present invention relates to a mounting device for various sized objects preferably coins or circular tokens where it is desirable to keep said items within a protective cover, viewable from the front and/or rear of said item.

BRIEF SUMMARY OF THE INVENTION

The present invention is a coin holder apparatus capable of displaying coins of different diameters.

In one embodiment, the present invention relates to an apparatus for holding a coin comprising:

(a) a front portion, comprising a plurality of scored regions;

(b) a back portion, comprising a plurality of scored regions; wherein said back portion and front portion are connected at a fold, (c) a transparent cover affixed to the inside of each of said front and back portions.

The article of the present invention has scored regions that are sized for different sized coins. For example, the scored regions may be sized for U.S. silver dollar, half dollar, quarter, dime, nickel, penny, and dollar coins and the like, as well as, for example, for foreign coins.

The article has a front portion and back portion are positionable over one another through interaction of a fold. The article further comprises a closing means, that is used when said front portion and said back portion are positioned over one another through interaction of a fold. The closing means may be an adhesive, or any other suitable means for securing the front and back portions to one another when they are positioned over each other through interaction of the incorporated fold.

The present invention also comprises a method for displaying a coin comprising:

(a) placing a coin in a holder with a front and back portion;

(b) removing a desired prescored portion from each of the front and back portions;

(c) joining front and back portions along a fold;

(d) applying a closing means to said joined front and back portions.

In the method, the front and back portions further comprise a transparent viewing area.

Further, the method provides a closing means as an adhesive deposed on the inner surface of said front and back portions. Alternatively, the closing means may be a clip that holds together said front and back portions.

In a preferred embodiment, the present invention comprises an apparatus for holding a coin comprising:

(a) a first layer, comprising a plurality of concentric scored circles;

(b) a second layer, comprising a plurality of concentric scored circles;

wherein each individual concentric scored circle is removable by the user in order beginning with the circle with the smallest diameter and removability of each concentric scored circle continuing in order of increasing diameter, whereby each of said first and second layers further comprises a transparent covering on the inner side and wherein each of said first and second layers are interposed onto each other through interaction of a shared fold.

The apparatus allows a user to individually remove each concentric scored circle in which removal is desired. Alternatively, the user may remove more than one concentric scored circle at a time.

The apparatus is preferably of rectangular sized cardboard structure measuring approximately 2×2 inches, creased so that it folds over forming two square halves of equal size. The apparatus includes a transparent film of the same approximate dimensions as the rectangular square cardboard structure affixed to the inside of the rectangular square structure on the interior of the rectangular square structure with two matching circles cut out from the cardboard in the center of each square half, each having a diameter corresponding relatively to a coin within the holder. Each square half opening has an opening created by perforated circles each having a slightly larger diameter so the opening can correlate to the size of the coin. In one embodiment, adhesive on the interior side of the plastic holds the two cardboard halves together in a sealed relationship.

It is an object of the present invention to provide a novel coin holder for holding any size coin whereby the opening is adjustable to match the size of the coin.

It is another object of the invention to provide a coin holder having openings created by perforated rings so that the opening can be tailored to the size of the coin therein.

It is other object of the invention to have a coin holder that is inexpensive and easy to use and manufacture.

DETAILED DESCRIPTION OF THE PREFERRED EMBODIMENTS

Figure 1:
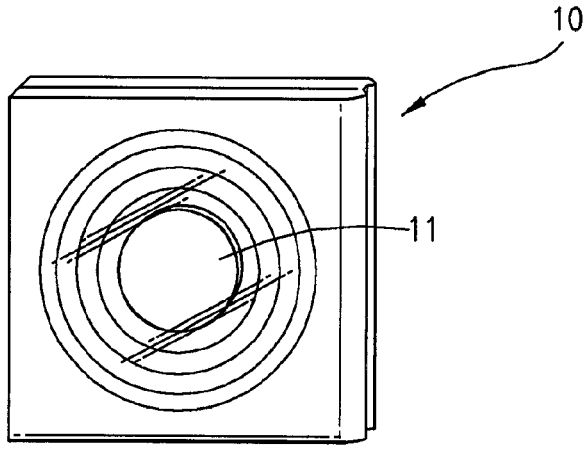
FIG. 1 is a perspective view of the coin holder of the present invention holding a coin.

In the following description numerous specific details are set forth. However it is understood that embodiments of the invention may be practiced without the specific details. In other instances, well known structures and techniques have not been shown in detail in order not to obscure the understanding of this invention. In the illustrated embodiments the coin holder 10 of the present invention is shown in FIG. 1. Within said coin holder 10 is a coin 11.

Figure 2:
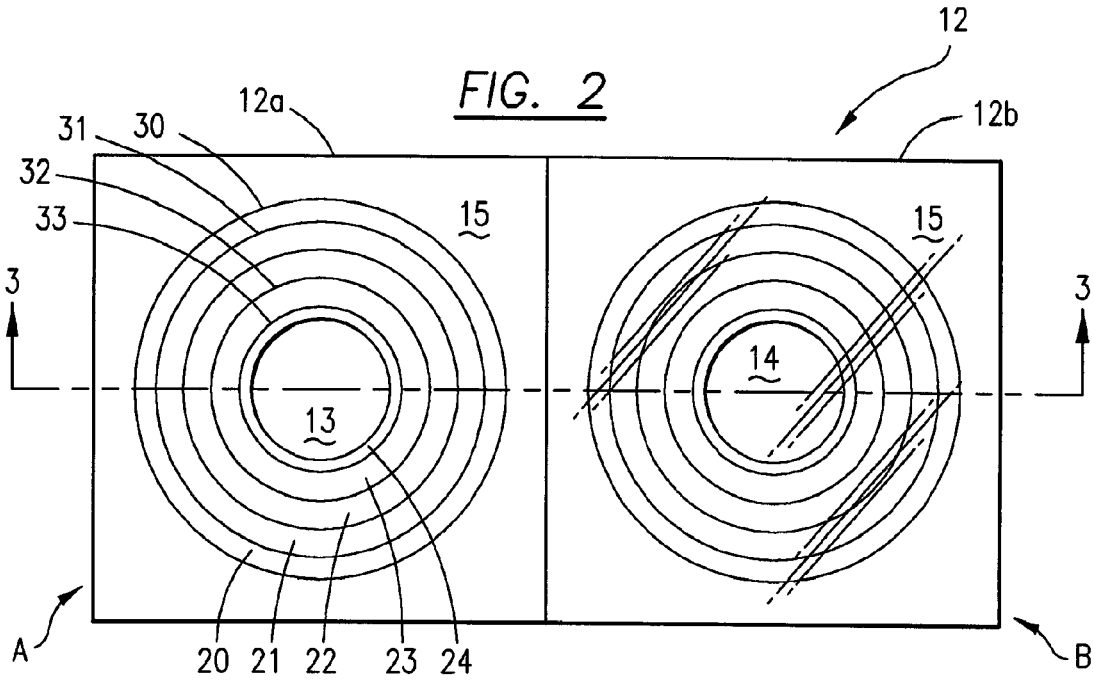
FIG. 2 is a plan view of the opening faces of the coin holder in an open position.

Referring to FIG. 2 said coin holder 10 includes a cardboard base 12 having a first opening 13 on side 12A and a second opening 14 on side 12B.

Figure 3:
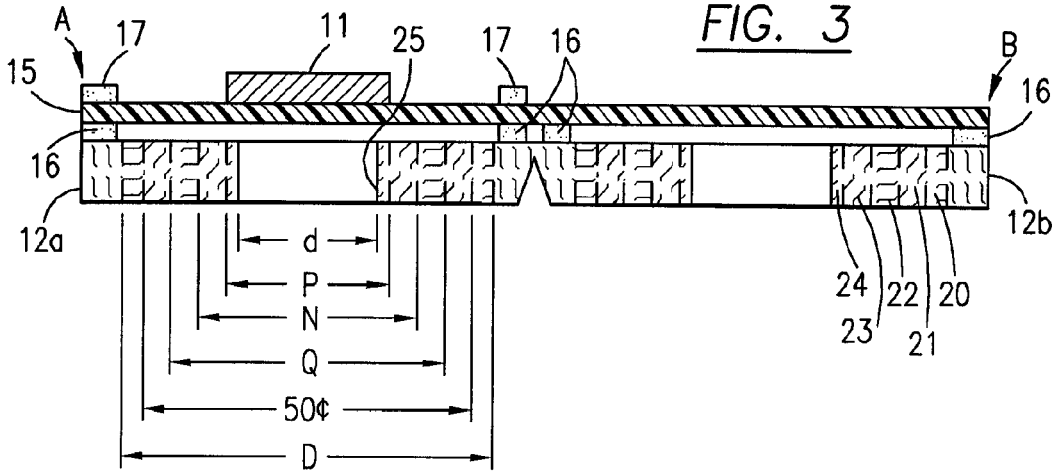
FIG. 3 is a section view of FIG. 2 along line 3-3.

Said coin holder 10 is constructed and arranged with perforated circles 20, 21, 22, 23 and 24. Each perforated circle is formed by perforation lines 30, 31, 32 and 33. As seen in FIG. 3 perforated circles 24, 23, 22, 21 and 20 are removable as needed to adjust the viewable area to the size of a coin 11. As shown in FIG. 1 the smallest coin 11, a dime, is surrounded by the concentric perforated circles. However, if a quarter were used or a silver dollar, it would be necessary to remove some of the removable circles (or rings) 24, 23, 22, 21 and/or 20 to make room for the size of the coin 11.

In use, a coin collector, for example would select a coin to be held in the coin holder. The diameter of the coin would be compared to the removable rings. The removable rings starting from the inside 24 would be removed until there was a corresponding size between the removable rings and the coin allowing the coin to be seen in full. The coin is then placed on a film or plastic sheet 15 as shown in FIG. 3. Thereafter FIG. 3 is closed over bringing point A to point B such that the apparatus is in a closed position as shown in FIG. 1. In this manner the coin is held securely within the plastic sheet 15. Preferably the inner edge of rings 20, 21, 22, 23 and 24 keep coin 11 within the center of plastic sheet 15 and openings 13 and 14.

Figure 4:
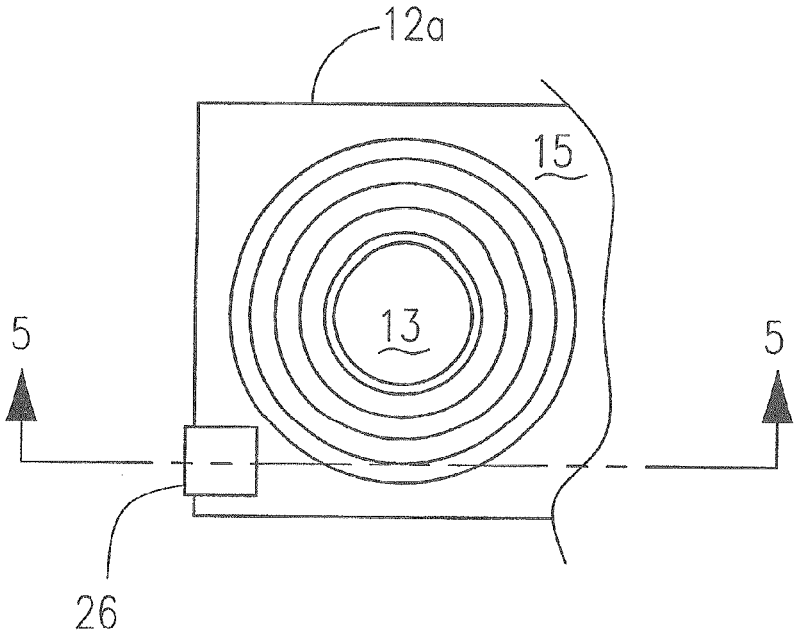
FIG. 4 is perspective view of the coin holder of the present invention showing a clip holding the front portion and the back portion in a fixed and closed position.
Figure 5:
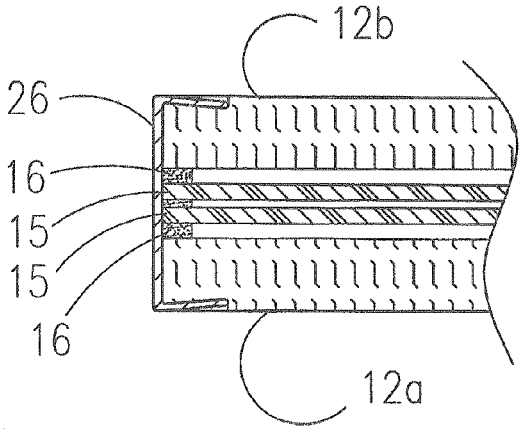
FIG. 5 is a sectional view of FIG. 4 along line 5-5.

Referring to FIG. 3, plastic sheet 15 is bonded to cardboard 12, by an adhesive 16 placed at strategic locations on cardboard 12, so as not to interfere with the removal of rings 20, 21, 22, 23 and/or 24 in either side 12*a* or 12*b* of cardboard 12, nor to interfere with viewing of coins, when rings 20, 21, 22, 23 and/or 24 are removed. Releasable adhesive 17 is shown on plastic sheet 15 on side 12*a*. When coin holder 10 is closed, side B is closed onto side A, coin holder 10 is held in a closed position by releasable adhesive 17 as shown in FIG. 1. Said adhesive 17 is likewise placed at strategic locations on plastic sheet 15 so as not to interfere with viewing of coins when rings 20, 21, 22, 23 and/or 24 are removed. Coin holder 10 may also be held in a closed position by clip 26 as shown ion FIGS. 4 and 5

Although the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A coin holding apparatus for holding a single coin comprising:

(a) a front portion, comprising a plurality of concentric scored regions integral therewith;

(b) a back portion, comprising a plurality of concentric scored regions integral therewith and congruent with said scored regions of said front portion; wherein said back portion and front portion are connected at a fold;

whereby said front and back portions are adapted to hold the single coin therebetween;

(c) a transparent cover affixed to the inside of each of said front and back portions.

2. The apparatus of claim 1 wherein said scored regions are sized for different sized coins.

3. The apparatus of claim 1 wherein said scored regions are sized for U.S. silver dollar, half dollar, quarter, dime, nickel, penny, and dollar coin.

4. The apparatus of claim 1 wherein said front portion and back portion are positionable over one another through interaction of said fold.

5. The apparatus of claim 1 wherein said front portion and back portion further comprise a closing means, wherein said closing means is used when said front portion and said back portion when positioned over one another through interaction of said fold.

6. The apparatus of claim 5 wherein said closing means is an adhesive.

7. The apparatus of claim 5 wherein said closing means is a clip.

8. A method for displaying a single coin comprising:

(a) placing the single coin in a holder with a front portion, comprising a plurality of concentric scored regions integral therewith and a back portion, comprising a plurality of concentric scored regions integral therewith and congruent with said scored regions of said front portion;

(b) removing a desired prescored portion from each of the front and back portions;

(c) joining front and back portions along a fold;

whereby the single coin is held between the front and back portions;

(d) applying a closing means to said joined front and back portions.

9. The method of claim 8 wherein said front portion further comprises a transparent viewing area.

10. The method of claim 8 wherein said closing means is an adhesive deposed on the inner surface of said front and back portions.

11. The method of claim 8 wherein said closing means is a clip that holds together said front and back portions.

12. A coin holding apparatus for holding a single coin comprising:

(a) a first layer, comprising a plurality of concentric scored circles integral therewith;

(b) a second layer, comprising a plurality of concentric scored circles integral therewith and congruent with said scored circles of said first layer;

wherein each individual concentric scored circle is removable by the user in order beginning with the circle with the smallest diameter and removability of each concentric scored circle continuing in order of increasing diameter, whereby each of said first and second layers further comprises a transparent covering on the inner side and wherein each of said first and second layers are interposed onto each other through interaction of a shared fold, whereby the first and second layers are adapted to hold the coin there between.

13. The apparatus of claim 12 wherein each concentric scored circle is adapted to be individually removed.

14. The apparatus of claim 12 wherein more than one concentric scored circle is adapted to be removed at a time.

* * * * *